US006371812B1

(12) United States Patent
Daikuhara et al.

(10) Patent No.: US 6,371,812 B1
(45) Date of Patent: Apr. 16, 2002

(54) PLUG CONNECTOR

(75) Inventors: Osamu Daikuhara; Junichi Akama, both of Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/640,712

(22) Filed: Aug. 18, 2000

Related U.S. Application Data

(63) Continuation of application No. 09/186,696, filed on Nov. 6, 1998.

(30) Foreign Application Priority Data

Aug. 20, 1998 (JP) ..... 10-234707

(51) Int. Cl.[7] ..... H01R 13/648
(52) U.S. Cl. ..... 439/608; 439/108
(58) Field of Search ..... 439/79, 80, 101, 439/108, 519, 541.5, 607, 608, 941, 676

(56) References Cited

U.S. PATENT DOCUMENTS

| | | | | |
|---|---|---|---|---|
| 4,762,500 A | | 8/1988 | Dola et al. | |
| 5,046,960 A | | 9/1991 | Fedder | |
| 5,055,069 A | | 10/1991 | Townsend et al. | |
| 5,066,236 A | * | 11/1991 | Broeksteeg | 439/79 |
| 5,090,919 A | | 2/1992 | Tsuji | |
| 5,195,899 A | | 3/1993 | Yatsu et al. | |
| 5,249,974 A | | 10/1993 | Wang | |
| 5,645,436 A | | 7/1997 | Shimizu et al. | |
| 5,779,503 A | * | 7/1998 | Tremblay et al. | 439/676 |

OTHER PUBLICATIONS

Akama, Junichi et al., "High Density Connector for Differential Data Transfer", 30th Annual Connector and Interconnection Symposium and Trade Show, Anaheim, California, Sep. 22–24, 1997, pp. 277–282.

Akama, Junichi et al., "High Density Connector for Differential Data Transfer", Technical Report of IEICE (Oct. 1997), pp. 25–29.

U.S. application No. 09/562,676, Daikuhara et al., filed May 1,2000.

* cited by examiner

*Primary Examiner*—Brian Sircus
*Assistant Examiner*—Son V. Nguyen
(74) *Attorney, Agent, or Firm*—Staas & Halsey LLP

(57) ABSTRACT

A plug connector includes an electrically insulating body including a housing and a pair of arms; a plurality of pairs of first and second right-angled signal contact elements supported by the housing such that the first right-angled signal contact element is arranged above the second right-angled signal contact element, each of the right-angled signal contact elements having a substantially right-angled contact portion protruding backward from the housing and a leading portion inserted into the housing, the contact portion having a horizontal part and a vertical part; a plurality of ground contact elements supported by the housing and disposed alternately with the plurality of pairs of first and second right-angled plug signal contacts, each of the ground contact elements provided with two ground terminals; and upper and lower electrically insulating brackets assembled to the housing. The upper bracket covering the horizontal parts of the plurality of first signal contact elements, the lower bracket covering the horizontal parts of the plurality of second signal contact elements, and the lower bracket being provided with holes into which the vertical parts of the first and second signal contact elements and the ground terminals are inserted.

8 Claims, 11 Drawing Sheets

PLUG CONNECTOR

This application is a continuation of application number 09/186,696, filed Nov. 6, 1998, now allowed.

BACKGROUND OF THE INVENTION

1. Field of the Invention

The present invention generally relates to a plug connector used for balanced transmission, and particularly relates to a plug connector provided with substantially right-angled contact portions protruded backward from the housing.

2. Description of the Related Art

Recently, along with rapid improvement in personal computers and computer networks, there is a need for transmitting a large amount of data, particularly moving-image data. In order to transmit a large amount of moving-image data, a high-speed transmission of at least 1 gigabit/sec is required. However, an unbalanced transmission system is not suitable for such a high-speed transmission since it is easily affected by noise. Thus, for a high-speed transmission, a balanced transmission system is preferred since it is less affected by noise as compared to the unbalanced transmission system.

Plug connectors can be roughly divided into straight-type plug connectors and right-angled type plug connectors. A straight-type plug connector is provided with contact elements protruded vertically downward from the housing. A right-angled type plug connector is provided with substantially right-angled or L-shaped contact elements protruding backward from the housing and bent vertically downward. Since lengths of the contact elements are longer for the right-angled contact elements, there is a higher possibility of requiring an impedance matching for the right-angled type plug connectors.

Therefore, there is a need for a plug connector which can be used in a balanced transmission system and which has a structure taking into account an impedance matching of signal contacts.

In the related art, a right-angled type plug connector taking in account an impedance matching is known, which plug connector is provided with a bracket made of electrically insulating synthetic resin covering the substantially right-angled contact elements protruding backward from the housing.

However, with the plug connector of the related art, since the bracket is provided beneath the contact elements, upper sides of the contact elements are completely exposed to the air. Therefore, an impedance matching is not sufficiently implemented by changing a material used as the synthetic resin of the bracket.

Therefore, there is a need for a plug connector having substantially right-angled contact elements and used for balanced transmission, which plug connector can easily implement an impedance matching.

SUMMARY OF THE INVENTION

Accordingly, it is a general object of the present invention to provide a plug connector which can satisfy the needs described above.

It is another and more specific object of the present invention to provide a plug connector which can effectively implement an impedance matching between positive signals and negative signals.

In order to achieve the above object, a plug connector includes:

an electrically insulating body including a housing and a pair of arms;

a plurality of pairs of first and second right-angled signal contact elements supported by the housing such that the first right-angled signal contact element is arranged above the second right-angled signal contact element, each of the right-angled signal contact elements having a substantially right-angled contact portion protruding backward from the housing and a leading portion inserted into the housing, the contact portion having a horizontal part and a vertical part;

a plurality of ground contact elements supported by the housing and disposed alternately with the plurality of pairs of first and second right-angled signal contact elements, each of the ground contact elements provided with two ground terminals; and upper and lower electrically insulating brackets assembled to the housing, wherein the upper bracket covering the horizontal parts of the plurality of first signal contact elements, the lower bracket covering the horizontal parts of the plurality of second signal contact elements, and the lower bracket provided with holes into which the vertical parts of the first and second signal contact elements and the ground terminals are inserted.

In the plug connector described above, an impedance of the first signal contact element and an impedance of the second signal contact element can be altered by changing the materials used for the upper and lower brackets. Also, since the plurality of first and second signal contact elements and the plurality of ground contact elements are alternately disposed, the above-described plug connector has a strip-line structure.

It is still another object of the present invention to provide a strip-line structure for the right-angled contact portions.

In order to achieve the above object, each of the plurality of ground contact elements has an extension protruding backward from the housing and a leading portion to be inserted into the housing, the extension having a size covering a projection area of the right-angled contact portions of the pair of first and second right-angled signal contact elements, the extension having an upper half part and a lower half part.

It is yet another object of the invention to protect the first and second signal contact elements from external noise.

In order to achieve the above object, the plug connector further includes an upper shielding member and a lower shielding member, the upper shielding member including a substantially L-shaped body part and upper shield terminals, the body part including a rectangular horizontal shielding plate part provided on an upper side of the housing and a rectangular vertical shielding plate part covering a backside of the upper bracket and a backside of the lower bracket, and the lower shielding member including a shield plate part of a rectangular shape and lower shield terminals.

BRIEF DESCRIPTION OF THE DRAWINGS

The above and other objects, features, and advantages of the present invention will become more apparent from the following description of preferred embodiments in connection with the accompanying drawings, in which.

DETAILED DESCRIPTION OF THE PREFERRED EMBODIMENTS

FIGS. 1, 2, 3 and 4A to 4E show a first embodiment of a plug connector 10 for balanced transmission. Arrows X1, X2 show opposite directions parallel to longitudinal sides of a front face of the connector 10. An arrow Y1 shows a direction perpendicular to and into the plane of the front face of the connector 10. An arrow Y2 shows a direction perpendicular to and out of the plane of the front face of the connector 10. Arrows Z1, Z2 show opposite directions parallel to lateral sides of a front face of the connector 10, the arrow Z1 showing an upward direction and the arrow Z2 showing a downward direction.

Figure 1:
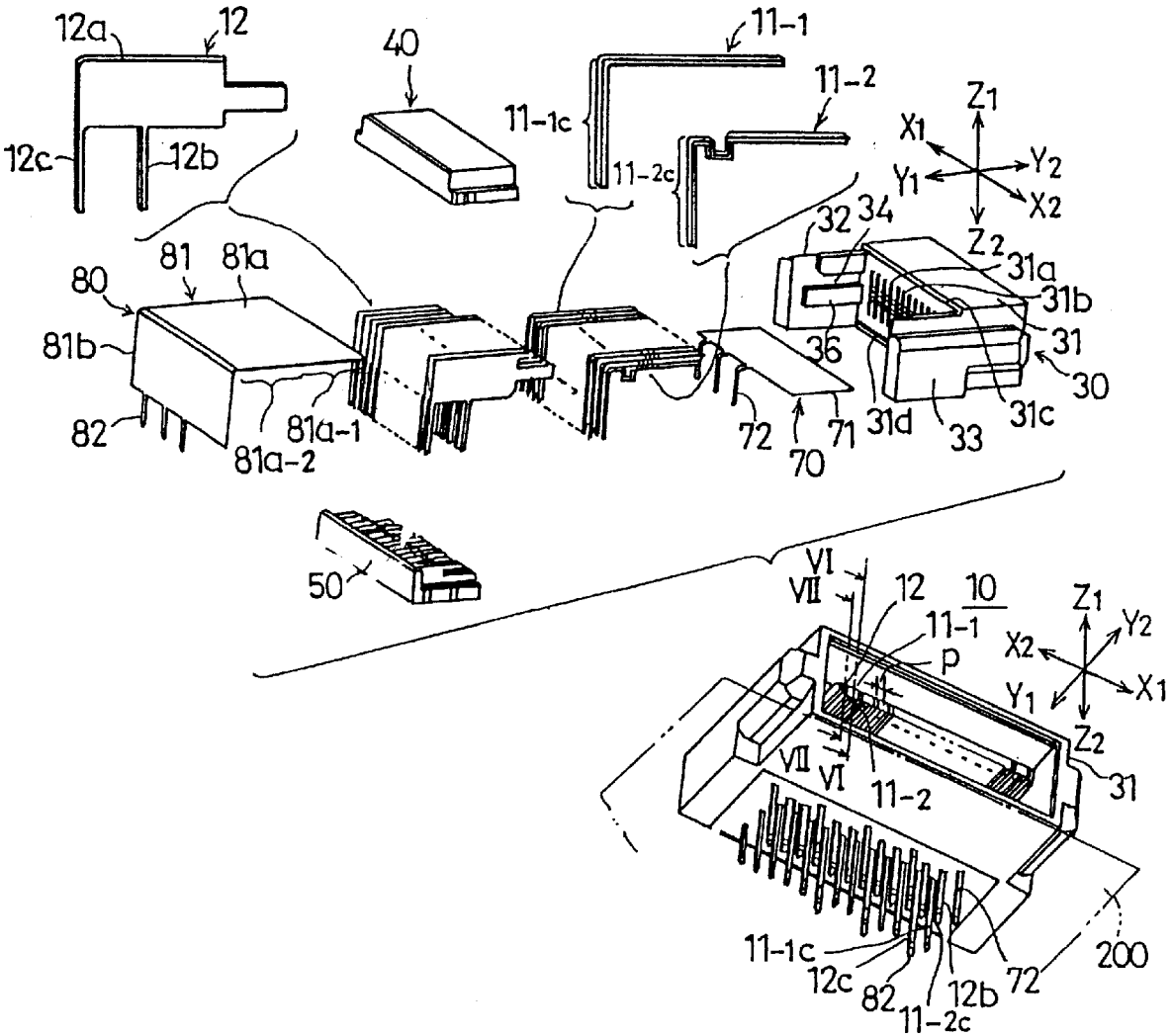
FIG. 1 is a diagram showing a plug connector of an embodiment of the invention with an exploded view of the plug connector.
Figure 6:
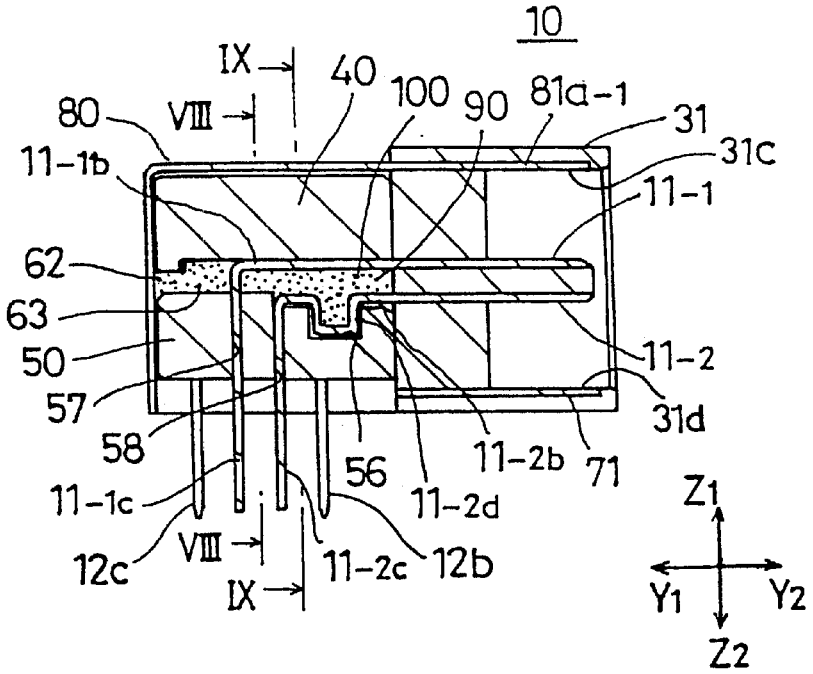
FIG. 6 is a cross-sectional diagram of the plug connector shown in FIG. 1 taken along a line VI—VI.

Referring to FIG. 1, the plug connector 10 includes a body 30 provided with first and second right-angled plug signal contacts 11-1, 11-2 and right-angled plug ground contacts 12. The body 30 is made of synthetic resin. The plug connector 10 also includes upper and lower brackets 40, 50 made of synthetic resin and upper and lower shielding members 80, 70. Further, as shown in FIG. 6, a cavity 90 provided between the upper and lower brackets 40, 50 is filled with epoxy resin 100.

The first right-angled plug signal contact 11-1 and the second right-angled plug signal contact 11-2 are adjacent to each other in a Y-Z plane so as to form a pair of right-angled plug signal contacts 11-1, 11-2. The plurality of pairs of first and second right-angled plug signal contacts 11-1, 11-2 and the right-angled plug ground contacts 12 are alternately disposed in the X1-X2 directions with a pitch p=0.635 mm. The characteristic impedance of the first and second right-angled plug signal contacts 11-1, 11-2 is 50Ω. Thus, the plug connector 10 is suitable for use in balanced transmission.

As shown in FIG. 1, the plug connector 10 is connected to a printed-circuit board 200 at a position near the edge of the printed-circuit board 200. The vertical parts of the right-angled plug signal contacts 11-1 and 11-2 and the right-angled plug ground contacts 12 are inserted into holes provided on the printed-circuit board 200 and are soldered to the printed-circuit board 200.

Figure 2:
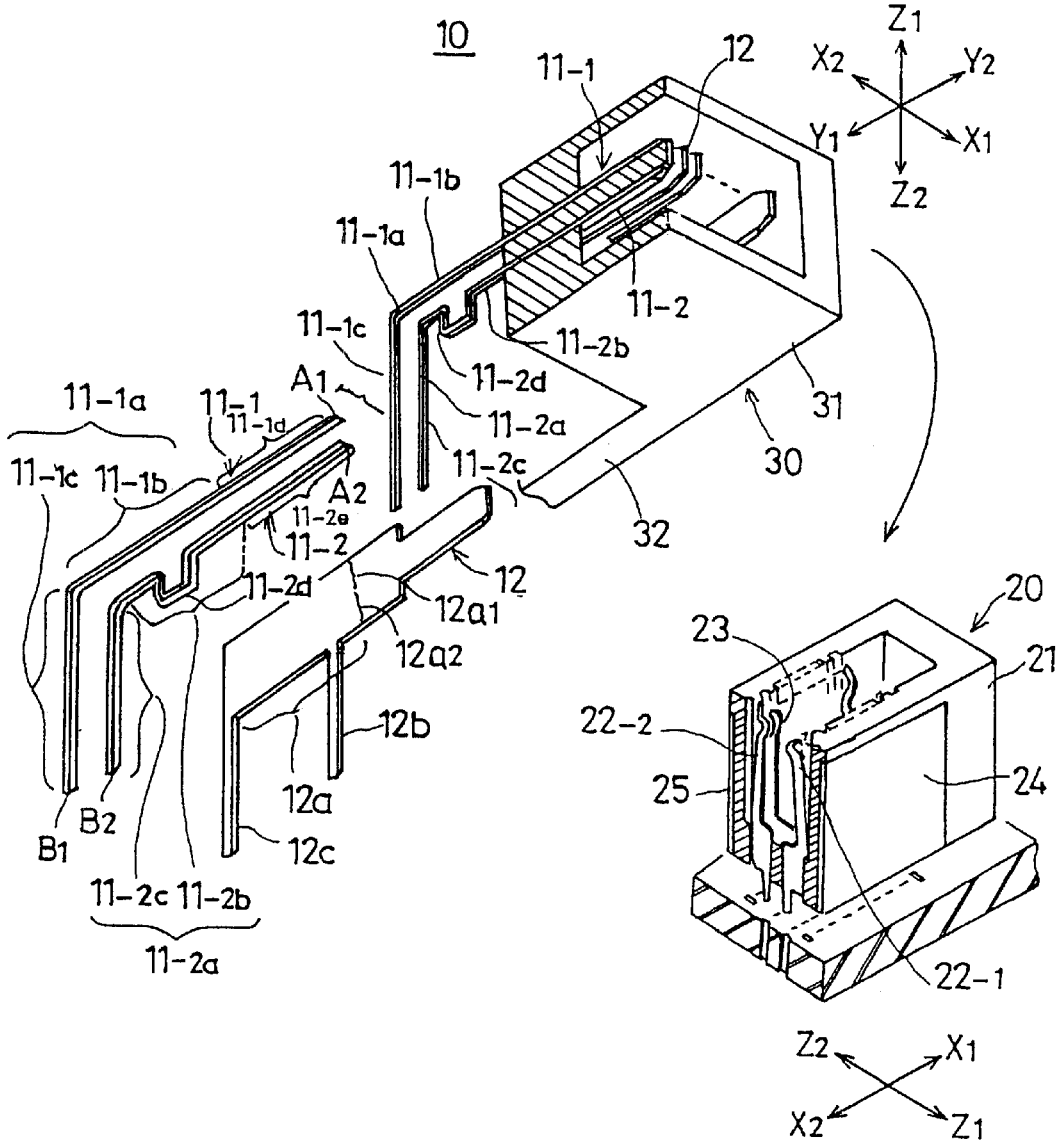
FIG. 2 is a diagram showing the plug connector shown in FIG. 1 with a corresponding jack connector.

FIG. 2 is a diagram showing the plug connector 10 with a corresponding jack connector 20. When in use, the plug connector 10 is connected to the jack connector 20. The jack connector 20 includes a box-shaped housing 21 provided with a plurality of pairs of jack signal contacts 22-1, 22-2 and a plurality of jack ground contacts 23 alternately disposed in the X1-X2 directions. The housing 21 is made of synthetic resin. Also, the jack connector 20 includes two rectangular shield plates 24, 25 provided on both sides of the housing 21 in the Z1, Z2 directions.

The plug connector 10 is assembled in the following order. First, the lower shielding member 70, the second right-angled plug signal contacts 11-2 and the first right-angled plug signal contacts 11-1, and the right-angled plug ground contacts 12 are inserted into the housing 31 of the body 30. Secondly, the upper bracket 40 and the lower bracket 50 are assembled to the housing 31. Thirdly, an epoxy resin 100 is filled into the cavity 90 shown in FIG. 6. Finally, the upper shielding member 80 is assembled to the housing 31. Now, the structure of the plug connector 10 will be described with respect to the above-mentioned order of assembly.

First, as mentioned above, the lower shielding member 70, the second right-angled plug signal contacts 11-2 and the first right-angled plug signal contacts 11-1, and the right-angled plug ground contacts 12 are inserted into the housing 31 of the body 30.

Figure 5:
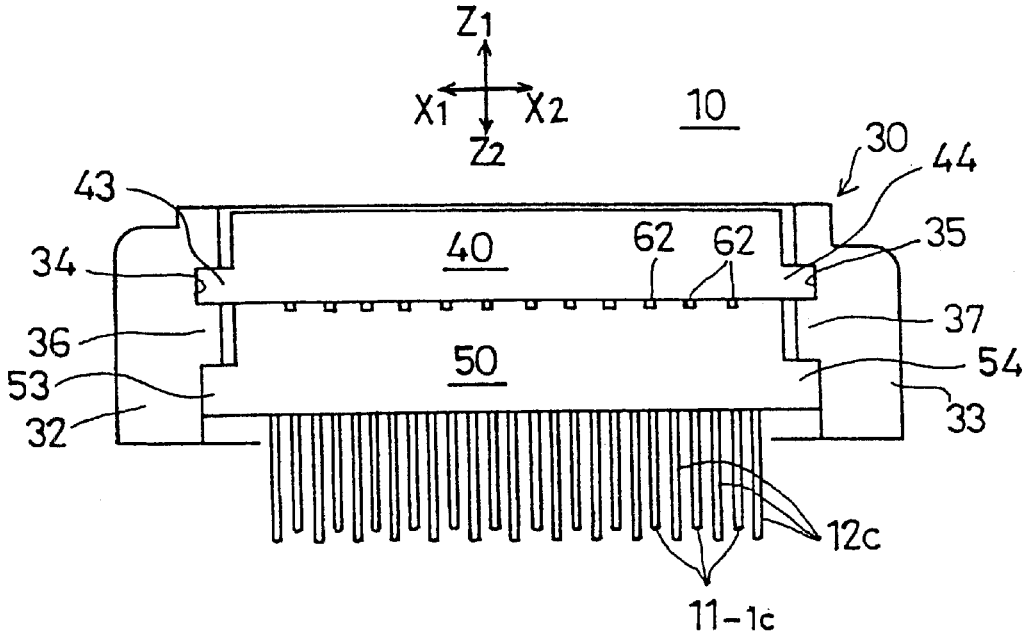
FIG. 5 is a rear elevation view showing the connector shown in FIG. 1 with the upper shielding member removed;.

The body 30 is made of liquid crystal polymer and has an electrically insulating characteristic. Referring to FIG. 1, the body 30 includes a box-shaped housing 31 and arms 32, 33 provided on the housing 31. The arms 32, 33 are provided on the X1, X2 direction sides of the housing 31 and extend in the Y1 direction. Referring to FIG. 5, recessed guide parts 34, 35 and raised guide parts 36, 37 are provided on opposing inner sides of the arms 32, 33 and extend in the Y1 direction. The housing 31 is provided with signal contact slits 31*a* and ground contact slits 31*b* alternately disposed in the X1-X2 directions. Also, the housing 31 is provided with an upper shield plate slit 31*c* on the Z1 side and a lower shield plate slit 31*d* on the Z2 side.

As shown in FIG. 1, the lower shielding member 70 includes a shield plate part 71 of a rectangular shape and lower shield terminals 72 formed at the Y1 end and extending vertically downward in the Z2 direction.

Figure 7:
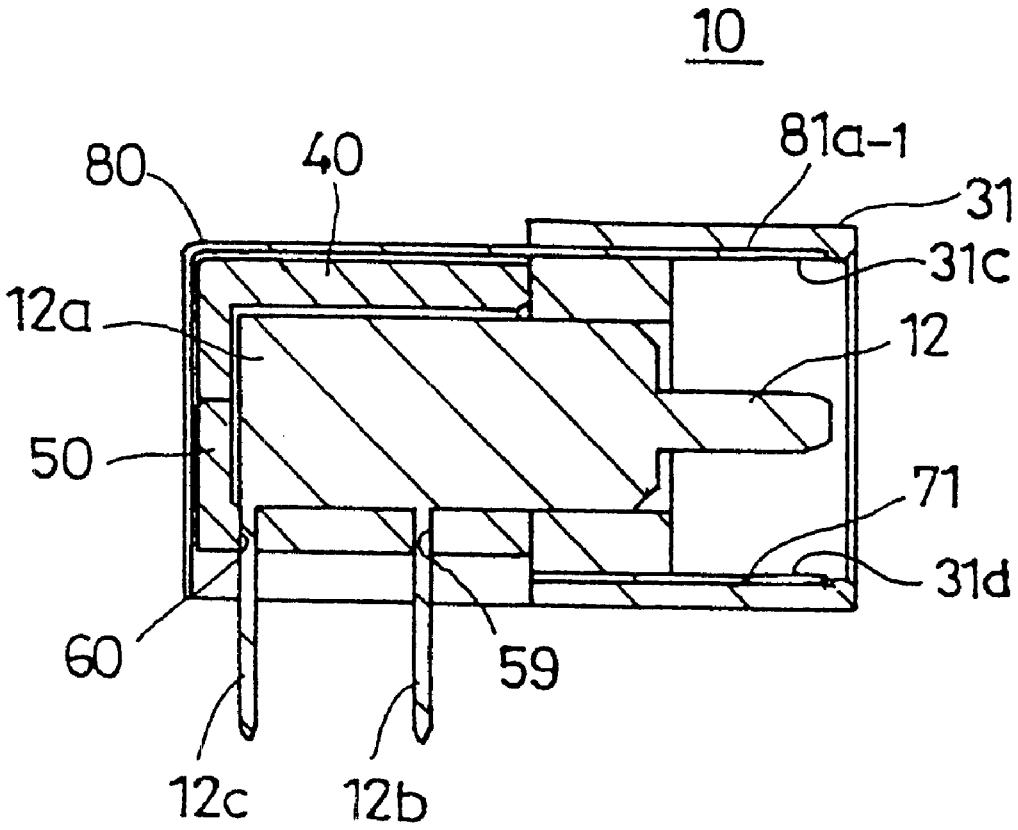
FIG. 7 is a cross-sectional diagram of the plug connector shown in FIG. 1 taken along a line VII—VII.

The lower shielding member 70 is assembled to the housing 31 from the backside (Y1 side) of the housing 31 in the Y2 direction. As shown in FIGS. 6 and 7, the shield plate part 71 is inserted into the lower shield plate slit 31*d* of the housing 31.

The first right-angled plug signal contacts 11-1 and the second right-angled plug signal contacts 11-2 are inserted into the housing 31 from the backside (Y1) of the housing 31 in the Y2 direction. The first right-angled plug signal contacts 11-1 are arranged at positions above the second right-angled plug signal contacts 11-2. Also, the first and second right-angled plug signal contacts 11-1, 11-2 are arranged in the same Y-Z plane.

Referring to FIG. 2, the first and second right-angled plug signals contacts 11-1, 11-2 will be described in detail.

Each of the plug signal contacts has a substantially right-angled contact portion 11-1*a*, 11-1*b* protruding backward (in the Y1 direction) from the housing 31 and a leading portion 11-1*d*, 11-2*e* to be inserted into the housing. The right-angled contact portion 11-1*a* has a horizontal part

11-1*b* extending in the Y2 direction and a vertical part 11-1*c* extending in the Z2 direction. The right-angled contact portion 11-2*a* has a horizontal part 11-2*b* extending in the Y2 direction, a vertical part 11-2*c* extending in the Z2 direction, and a length adjusting part 11-2*d* provided on the horizontal part 11-2*b*. The length adjusting part 11-2*d* has a cranked shape extending downward in the Z2 direction. The length adjusting part 11-2*d* is provided so that the length of the first right-angled plug signal contact 11-1 from an end A1 to an end B1 and the length of the second right-angled plug signal contact 11-2 from an end A2 to an end B2 are equal.

The ground contact 12 has a plate-like shape and is inserted into the housing 31 from the backside in the Y2 direction. The ground contact 12 is provided with a plate-like extension 12*a* protruding in the Y1 direction and two ground terminals 12*b*, 12*c* extending downward from the extension 12*a* in the Z2 direction. The extension 12*a* may be further divided into an upper half part 12*a*1 and a lower half part 12*a*2.

The ground contact 12 has a size covering a projection area of the pair of first and second right-angled plug signal contacts 11-1, 11-2 in the X1 direction. The extension 12*a* has a size covering a projection area of the right-angled contact portions 11-1*a*, 11-1*b* in the X1 direction. The above-described elements are arranged such that from the Y2 direction to the Y1 direction, there are provided the ground terminal 12*b*, the vertical part 11-2*c* of the second contact 11-2, the vertical part 11-1*c* of the first contact 11-1, and the ground terminal 12*c* (see FIGS. 4C and 4D).

Secondly, the upper bracket 40 and the lower bracket 50 are assembled to the housing 31. The upper bracket 40 will be described with reference to FIGS. 5, 10 and 11. The upper bracket 40 is made of liquid crystal polymer and has an electrically insulating characteristic. The upper bracket 40 is provided with a plurality of upper-bracket signal contact grooves 41 extending in Y1-Y2 directions and corresponding to the horizontal parts 11-1*b* of the first right-angled plug signal contacts 11-1, a plurality of upper-bracket ground contact grooves 42 extending in Y1-Y2 directions and corresponding to the upper half parts 12*a*1 of the extensions 12*a*, and rails 43, 44 provided at either one of X1, X2 ends. The upper-bracket signal contact grooves 41 and the upper-bracket ground contact grooves 42 are alternately arranged. Partition walls 45 are provided between the upper-bracket signal contact grooves 41 and the upper-bracket ground contact grooves 42. The upper-bracket signal contact grooves 41 and the upper-bracket ground contact grooves 42 terminate at the Y2 end of the upper bracket 40.

Figure 8:
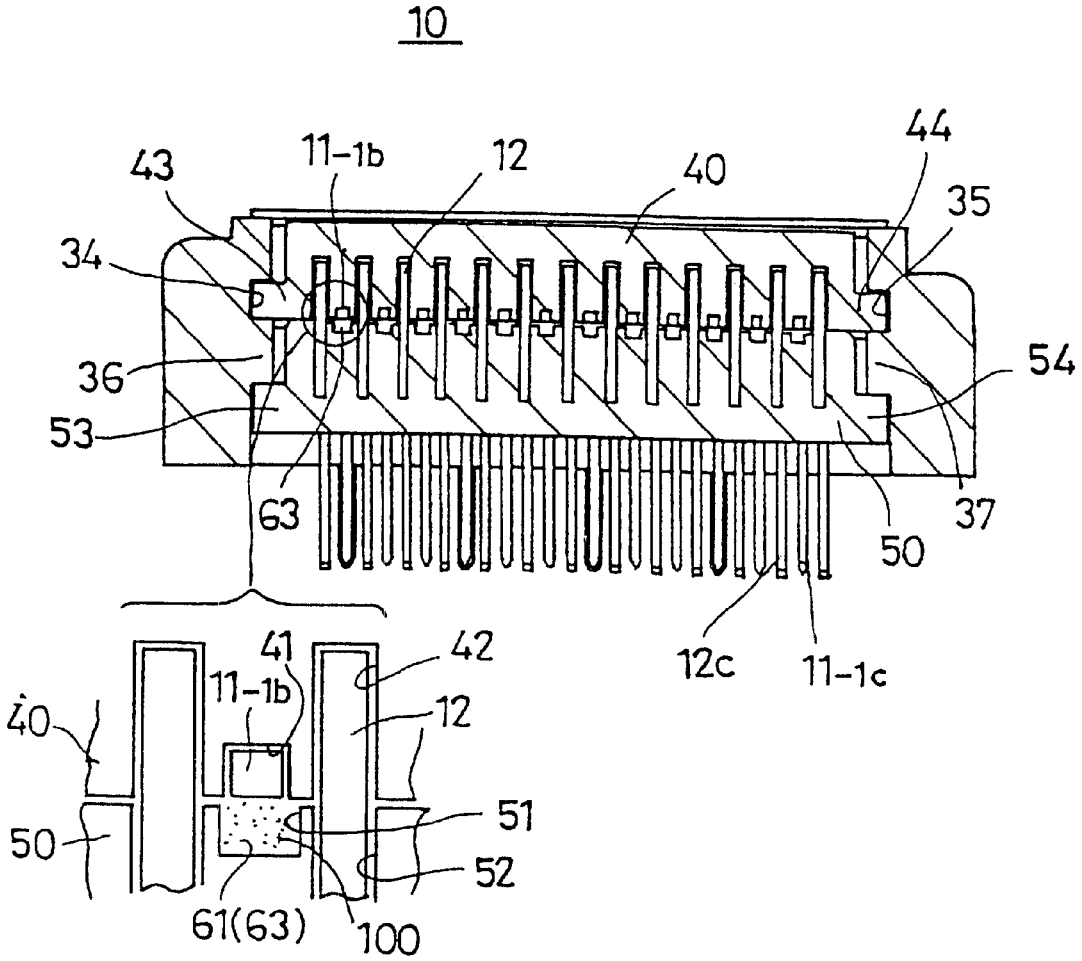
FIG. 8 is a cross-sectional diagram of the plug connector shown in FIG. 6 taken along a line VIII—VIII.
Figure 9:
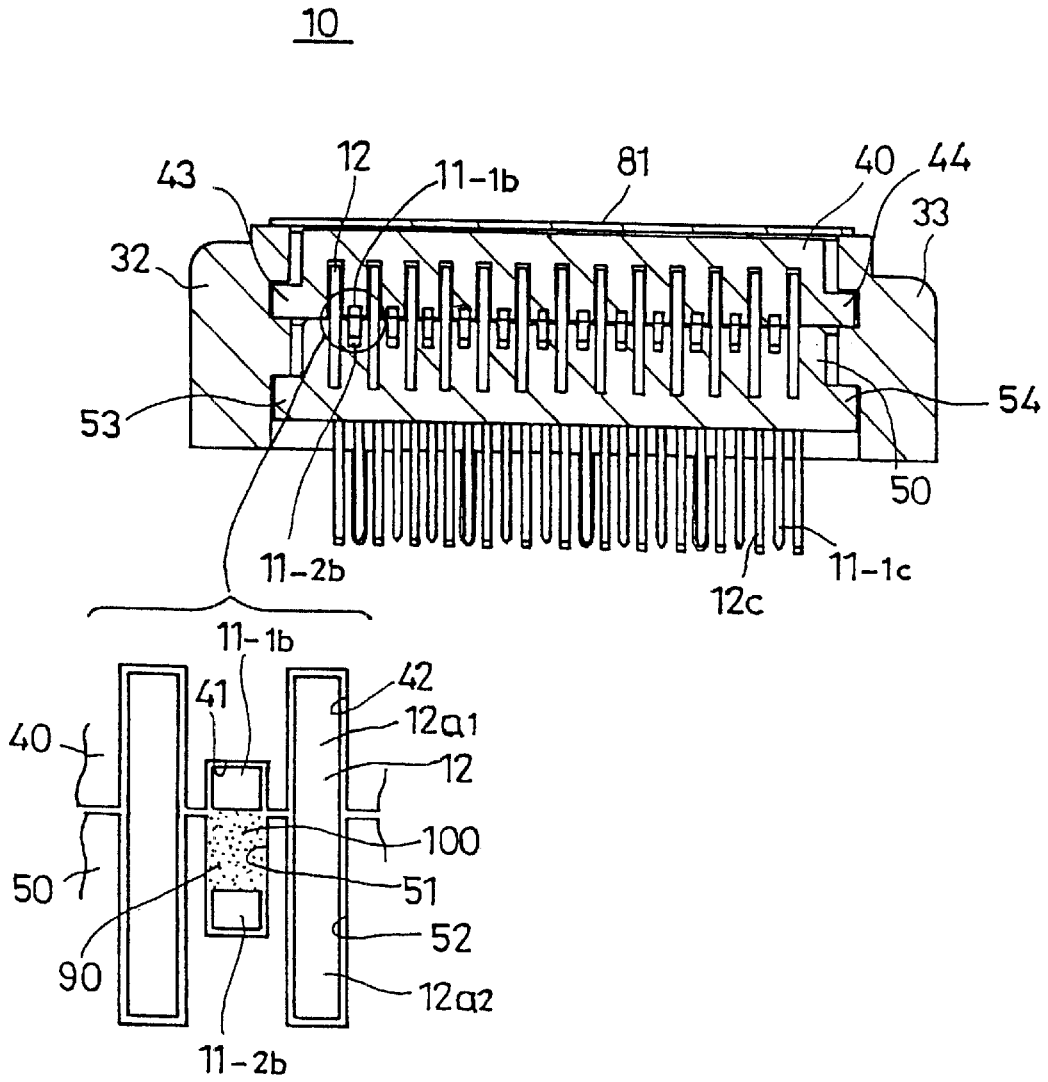
FIG. 9 is a cross-sectional diagram of the plug connector shown in FIG. 6 taken along a line IX—IX.
Figure 10:
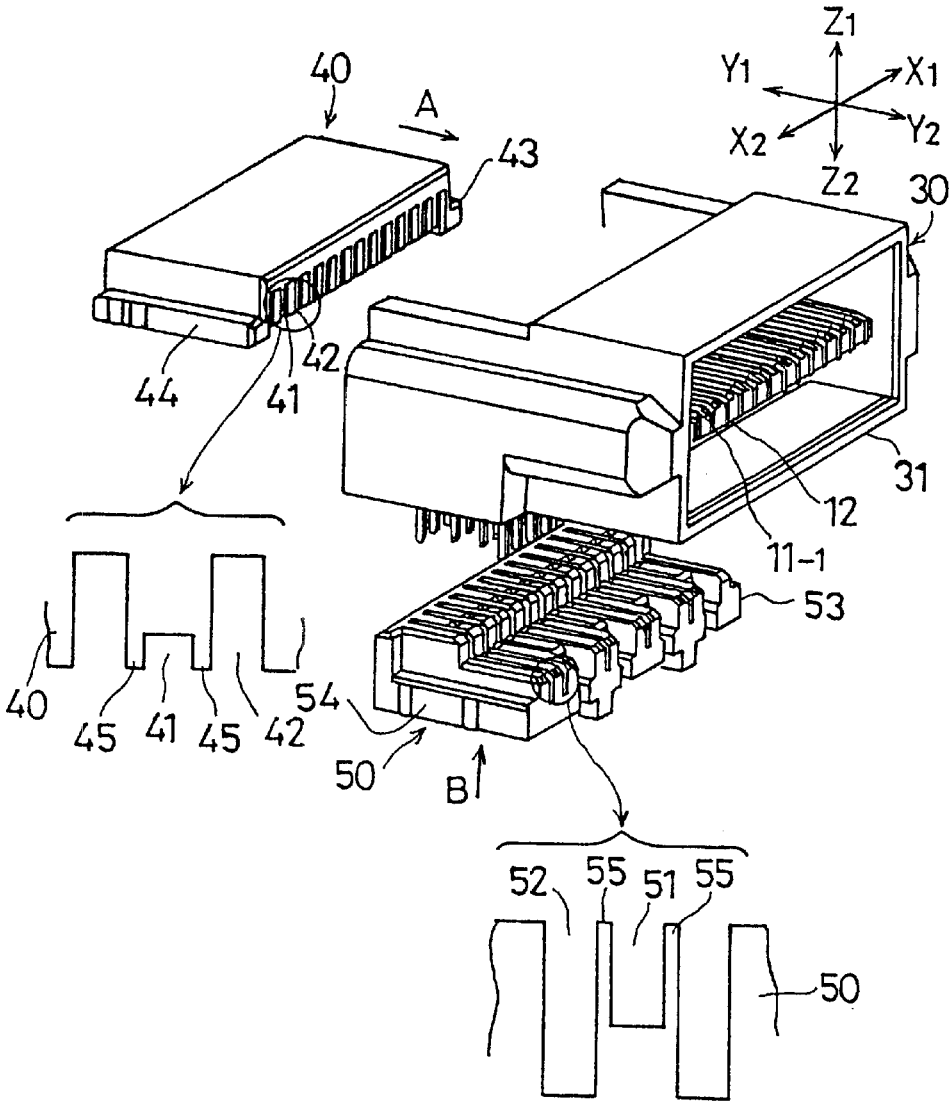
FIG. 10 is a perspective diagram showing how the upper and lower brackets are incorporated into the housing.

FIG. 10 is a diagram showing how the upper and lower brackets 40, 50 are assembled to the housing 31. The upper bracket 40 is slid into the housing 31 in the direction shown by an arrow A with the upper-bracket signal contact grooves 41 fitted with the horizontal parts 11-1*b* of the first right-angled plug signal contacts 11-1 and the upper-bracket ground contact grooves 42 fitted with the extension 12*a* of the right-angled plug ground contacts 12. As shown in FIGS. 8 and 9, the rails 43, 44 are tightly fitted into the recessed guide parts 34, 35.

As shown in FIGS. 6, 8 and 9, the upper-bracket signal contact groove 41 is fitted with the horizontal part 11-1*b* of the first right-angled plug signal contact 11-1. That is to say, the upper-bracket signal contact groove 41 substantially covers the upper surface and both side surfaces of the horizontal part 11-1*b* of the first right-angled plug signal contact 11-1. As shown in FIGS. 7, 8, and 9, the upper-bracket ground contact groove 42 covers the upper half part 12*a*1 of the extension 12*a* of the ground contact 12.

Figure 11:
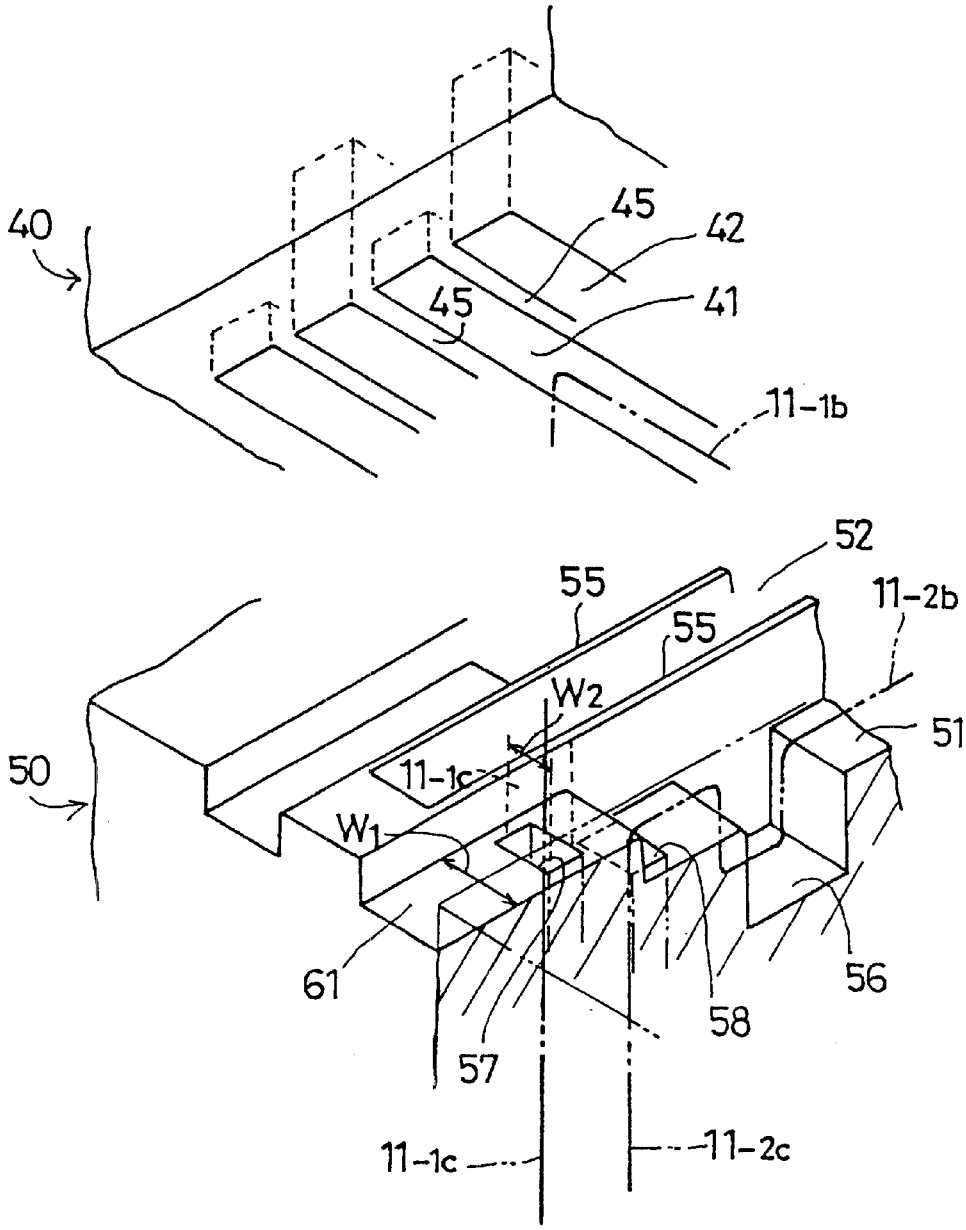
FIG. 11 is an enlarged diagram showing a perspective rear view of the upper bracket and the lower bracket.

Referring to FIGS. 5, 10 and 11, the lower bracket 50 will be described. The lower bracket 50 is made of liquid crystal polymer and has an electrically insulating characteristic. The lower bracket 50 is provided with a plurality of lower-bracket signal contact grooves 51 extending in the Y1-Y2 directions and corresponding to the horizontal part 11-2*b* of the second contact 11-2, a plurality of lower-bracket ground contact grooves 52 extending in the Y1-Y2 directions and corresponding to the lower half part 12*a*2 of the extension 12*a* and rails 53, 54 provided at both X1, X2 ends. The lower-bracket signal contact grooves 51 and the grooves 52 are alternately arranged. Partition walls 55 are provided between the lower-bracket signal contact grooves 51 and the grooves 52.

As shown in FIG. 6, the lower-bracket signal contact groove 51 has a pit 56 and holes 57 and 58. The pit 56 corresponds to the length adjusting part 11-2*d*. The holes 57 and 58 correspond to the vertical parts 11-1*c*, 11-2*c* of the first and second right-angled plug signal contacts 11-1, 11-2, respectively.

As shown in FIG. 7, the lower-bracket signal contact groove 52 has holes 59 and 60. The holes 59 and 60 correspond to the ground terminals 12*b*, 12*c* of the ground contact 12, respectively. The lower-bracket signal contact grooves 51 and the grooves 52 terminate at the Y2 end of the lower bracket 50. As shown in FIG. 11, the Y1 end of the lower-bracket signal contact groove 51 is provided with a synthetic resin injection groove 61, which extends to the Y1 end of the lower bracket 50.

Again referring to FIG. 10, the lower bracket 50 is slid into the housing 31 in the direction shown by an arrow B with the holes 57, 58, 59 and 60 fitted with the vertical parts 11-1*c*, 11-2*c* of the first and second right-angled plug signal contacts 11-1, 11-2 and the ground terminals 12*b*, 12*c*, respectively. As shown in FIGS. 8 and 9, the rails 53, 54 are tightly. fitted between the arms 32, 33 until the rails 53, 54 abut the raised guide parts 36, 37. Thus, the lower bracket 50 is fitted such that its upper surface abuts the lower surface of the upper bracket 40.

As shown in FIGS. 6, 8 and 9, the lower-bracket signal contact groove 51 is fitted with the horizontal part 11-2*b* of the second right-angled plug signal contact 11-2. That is to say, the lower-bracket signal contact groove 51 substantially covers the upper surface and both side surfaces of the horizontal part 11-2*b* of the second signal right-angled plug signal contact 11-2. As shown in FIGS. 7, 8, and 9, the lower-bracket signal contact groove 52 covers the lower half part 12*a*2 of the extension 12*a* of the ground contact 12. The length adjusting part 11-2*d* is accommodated in a pit 56. Also, the vertical parts 11-1*c*, 11-2*c* of the first and second right-angled plug signal contacts 11-1, 11-2 and the ground terminals 12*b*, 12*c* penetrate the holes 57, 58, 59 and 60, respectively, and protrudes from the lower surf ace of the lower bracket 50 in the direction Z2.

As shown in FIG. 9, the lower-bracket signal contact grooves 51 and the upper-bracket signal contact grooves 41 are provided so as to be opposing each other. Thus, the cavity 90 is formed between the horizontal parts 11-1*b*, 11-2*b* of the first and second right-angled plug signal contacts 11-1, 11-2. As shown in FIG. 6, the Y1 end of the cavity 90 is closed by the back surface of the housing 21. The cavity 90 is filled with the epoxy resin 100.

Referring to FIGS. 5 and 6, it can be seen that the upper surface of the lower bracket 50 abuts the lower surface of the upper bracket 40. Thus, at the backside of the plug connector 10, synthetic resin injection inlets 62 are formed by the synthetic resin injection grooves 61 and the lower surface of the upper bracket 40. Also, a synthetic resin injection channel 63 extends from a respective one of the synthetic resin injection inlets 62. The synthetic resin injection inlet 62 and the synthetic resin injection channel 63 are provided for each one of the plurality of pairs of right-angled plug signal contacts 11-1, 11-2.

In FIG. 6, it may be seen that the top part of the vertical part 11-1*c* of the first right-angled plug signal contact 11-1 traverses the synthetic resin injection channel 63 in the Z1-Z2 directions. However, as shown in FIG. 11, a width W1 of the synthetic resin injection groove 61 (or of the synthetic resin injection channel 63) is larger than a width W2 of the vertical part 11-1*c* of the first right-angled plug signal contact 11-1. Thus, a gap 64 is formed on both sides of the vertical part 11-1*c* of the first right-angled plug signal contact 11-1. Therefore, the epoxy resin is injected through injection channels also at positions where the vertical parts 11-1*c* are provided.

Figure 12:
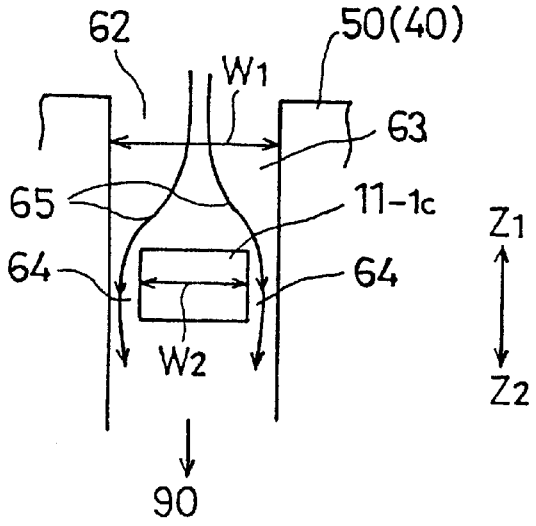
FIG. 12 is a diagram showing how an epoxy resin is injected into a cavity.

Thirdly, the epoxy resin is filled into the cavity 90 shown in FIG. 6. FIG. 12 is a diagram showing how the epoxy resin is injected into the cavity 90. The epoxy resin is injected after the upper bracket 40 and the lower bracket 50 are assembled. As shown in FIG. 12, the body 30 is held such that the synthetic resin injection inlets 62 are facing vertically upward. Then, the epoxy resin is injected into each synthetic resin injection inlet 62 using a dispenser (not shown). The injected epoxy resin will flow down in the synthetic resin injection channel 63 due to the gravity in the direction shown by arrows 65. The epoxy resin then passes through the gap 64, flows into the cavity 90 and is filled in the cavity 90.

The epoxy resin filled in the cavity 90 adheres the lower surface of the horizontal part 11-1*b* of the first right-angled plug signal contact 11-1 and the upper surface of the horizontal part 11-2*b* of the second right-angled plug signal contact 11-2.

Finally, the upper shielding member 80 is assembled to the housing 31. As shown in FIGS. 1 and 2, the upper shielding member 80 has a substantially L-shaped body part 81 and upper shield terminals 82. The body part 81 has a rectangular horizontal shielding plate part 81*a* and a rectangular vertical shielding plate part 81*b*. Also, the horizontal shielding plate part 81*a* may be divided into a front half part 81*a*-1 and a rear half part 81*a*-2.

Figure 3:
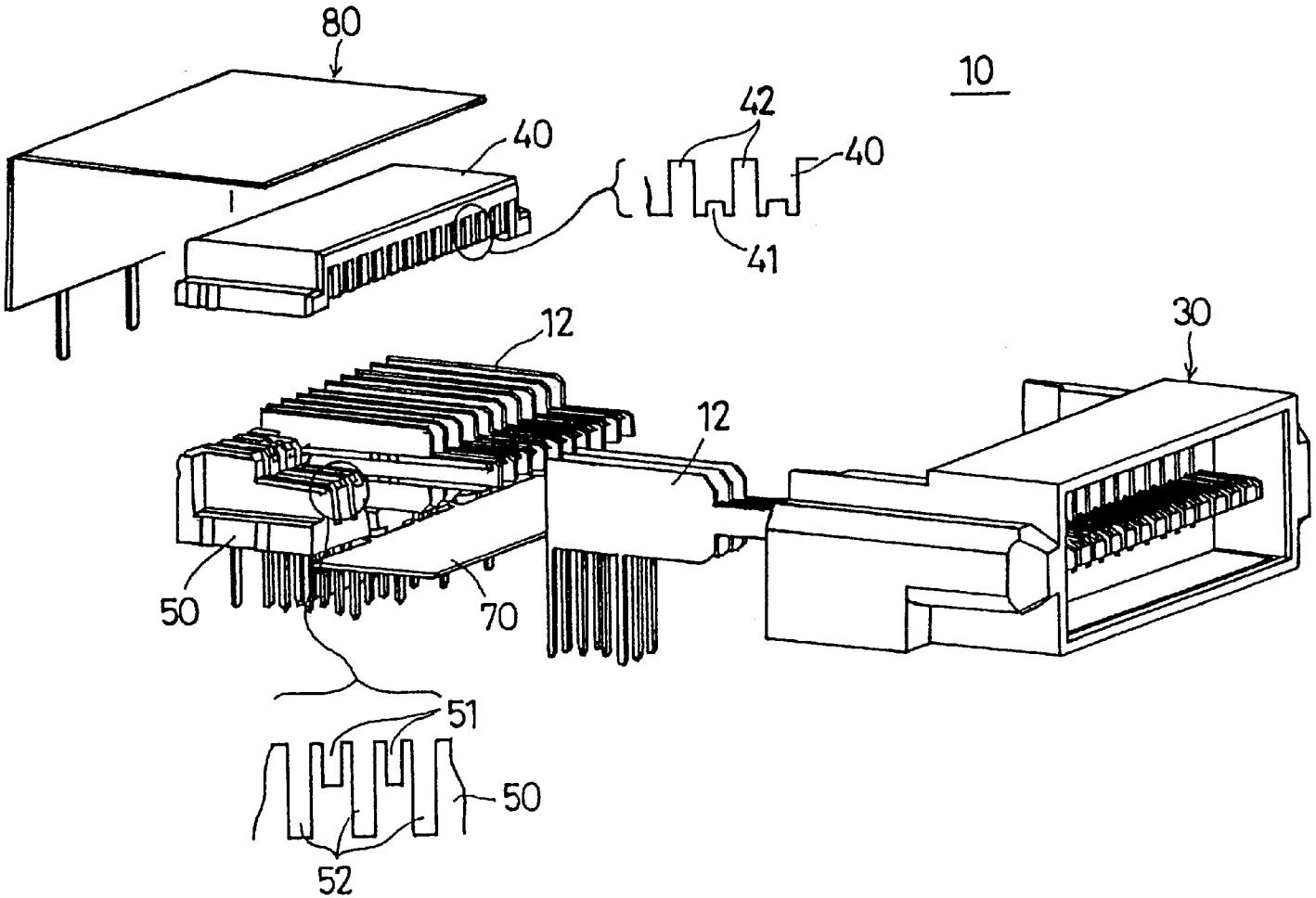
FIG. 3 is an exploded view of a plug connector of an embodiment of the invention viewed from the front side of the plug connector.
Figure 4A:
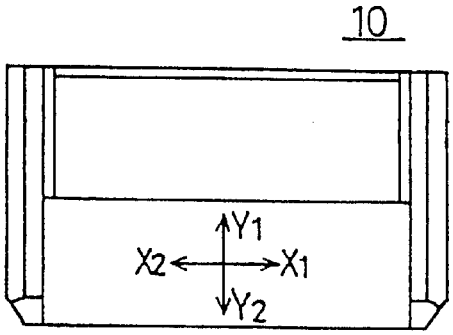
FIGS. 4A to 4E are a top plan view, a front elevation view, a side view, a bottom view and a rear elevation view, respectively, of the plug connector shown in FIG. 1.
Figure 4C:
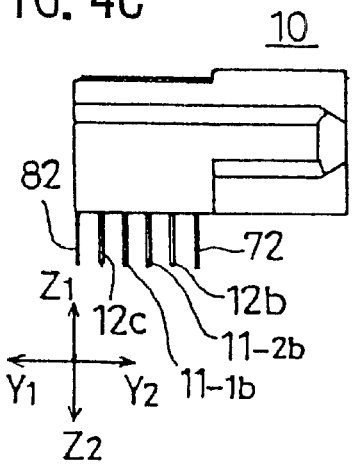
Figure 4B:
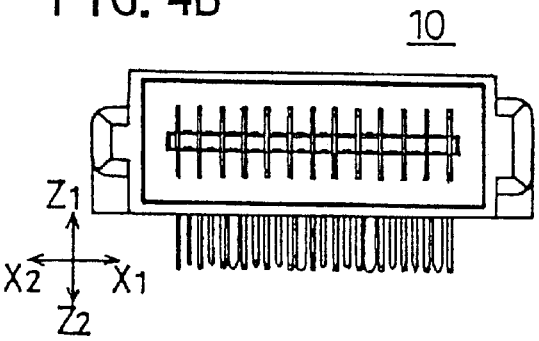
Figure 4D:
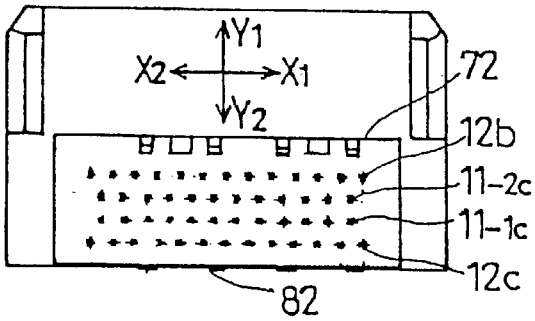
Figure 4E:
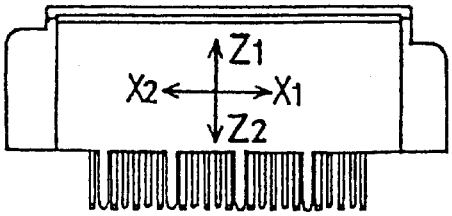

As shown in FIGS. 1 and 3, the upper shielding member 80 is assembled to the housing from the backside in the Y1 direction. Referring to FIGS. 6 and 7, the front half part 81*a*-1 is inserted into the upper shield plate slit 31*c* of the housing 31 and the rear half part 81*a*-1 covers the upper surface of the upper bracket 40. The vertical shielding plate part 81*a* covers the back surfaces of the upper bracket 40 and the lower bracket 50 and also the synthetic resin injection inlet 62.

The plug connector 10 has characteristics and effects as follows. First, it is easy to implement an impedance matching between the first right-angled plug signal contact 11-1 and the second right-angled plug signal contact 11-2. Secondly, it is possible to reduce an occurrence of a skew between the signal transmitted by a balanced transmission through the first right-angled plug signal contact 11-1 and the second right-angled plug signal contact 11-2. Thirdly, the plug connector 10 has a strip-line structure. Fourthly, the plug connector 10 is provided with a virtual ground plane. Finally, the plug connector 10 is provided with an external shield. These characteristics and effects will be described in detail in the following description.

First, an impedance matching between the first right-angled plug signal contact 11-1 and the second right-angled plug signal contact 11-2 is described. As shown in FIGS. 6 to 9, the substantially right-angled first and second contact portions 11-1*a*, 11-2*a* of the first and second right-angled plug signal contacts 11-1, 11-2 are covered by the upper and lower brackets 40, 50 made of liquid crystal polymer and the epoxy resin 100. Thus, the first and second contact portions 11-1*a*, 11-2*a* have a minimum area exposed to the air. Then, it is possible to alter the impedance of the first and second right-angled plug signal contacts 11-1, 11-2 by changing the materials used for the upper and lower brackets 40, 50 and for the epoxy resin 100 with materials of different permittivities. Thus, an impedance matching between the first and second right-angled plug signal contacts 11-1 and 11-2 is possible.

Also, even in case where the cavity 90 is not filled with the epoxy resin 100 so that the cavity 90 is filled with air, an impedance matching between the first and second right-angled plug signal contacts 11-1 and 11-2 is possible by changing the materials used for the upper and lower brackets 40 and 50. However, in this case, since there will be some portions along the first and second right-angled plug signal contacts 11-1 and 11-2 where it is not possible to change the permittivities, the range of the impedance will be narrower than in the case where the cavity 90 is filled with the epoxy resin 100. Therefore, it is easier to implement impedance matching when the cavity 90 is filled with the epoxy resin 100.

In the present embodiment, the upper and lower brackets 40, 50 are made of liquid crystal polymer having a permittivity of approximately 3 and the epoxy resin 100. Also, the first and second right-angled plug signal contacts 11-1, 11-2 are adjusted so as to have a characteristic impedance of 50 Ω.

Secondly, it is possible to reduce an occurrence of a skew between the signal transmitted by a balanced transmission through the first right-angled plug signal contact 11-1 and the second right-angled plug signal contact 11-2. Referring to FIG. 2, since the length adjusting part 11-2*d* is provided, the length of the first right-angled plug signal contact 11-1 from the end A1 to the end B1 and the length of the second right-angled plug signal contact 11-2 from the end A2 to the end B2 are equal. Here, the plug connector 10 is used for balanced transmission such that positive signals (+) are transmitted through the first right-angled plug signal contacts 11-1 and the negative signals (−), which are equal and opposite to the positive signals, are transmitted through the second right-angled plug signal contacts 11-2. In this case there will be no time difference (skew) between the positive signals (+) and the negative signals (−). Therefore, the plug connector 10 can transmit high-speed signals of over 10 Gbit/sec with high reliability.

Also, since the length adjusting parts 11-2*d* are provided, an adjustment at the printed-circuit board 200 whereon the plug connector 10 is mounted is not required. In other words, it is not necessary to adjust the length by bending the wiring patterns of the printed-circuit board 200 connected to the second right-angled plug signal contacts 11-2.

Figure 13:
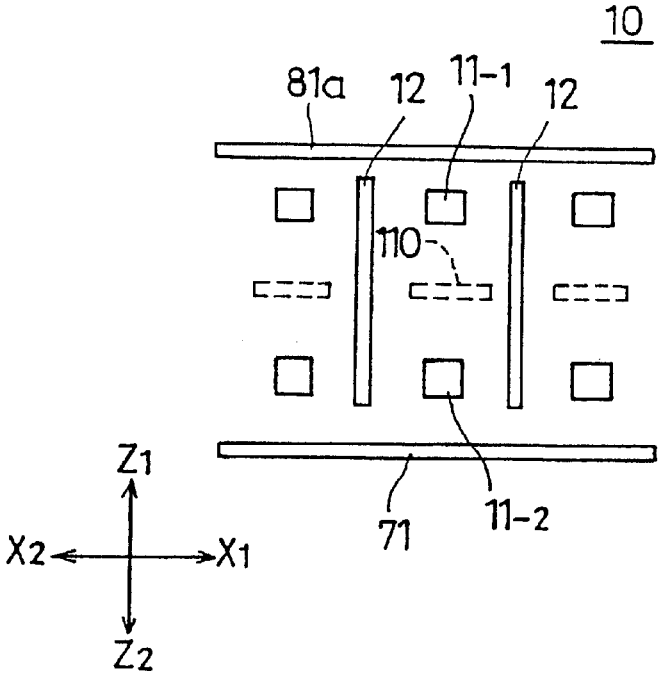
FIG. 13 is a diagrammatic view of a basic structure of the plug connector shown in FIG. 1.

Thirdly, the plug connector 10 has a strip-line structure. As shown in FIG. 13, the ground contact 12 is provided between the neighboring pairs of the first and second right-angled plug signal contacts 11-1, 11-2. This shows that the plug connector 10 has a strip-line structure. Since the extension 12*a* has a size covering the projection area of the first and second contact portions 11-1*a*, 11-1*b* in the X1 direction, the strip-line structure is also formed for the first and second contact portions 11-1*a*, 11-2*a*. Therefore, it is possible to effectively reduce crosstalk between signals transmitted through the neighboring pairs of first and second right-angled plug signal contacts 11-1, 11-2.

Fourthly, the plug connector 10 is provided with a virtual ground plane. Referring to FIG. 13, during transmission, a virtual ground plane 110 is formed between the first and second right-angled plug signal contacts 11-1 and 11-2 of each pair of right-angled plug signal contacts 11-1, 11-2. Therefore, it is possible to effectively reduce crosstalk between the positive signals (+) transmitted through the first right-angled plug signal contacts 11-1 and the negative signals (−) transmitted through the second right-angled plug signal contacts.

Finally, the plug connector 10 is provided with an external shield. Referring to FIG. 6, the front half part 81*a*-1 of the horizontal shield plate part 81*a* and the shield plate part 71 inserted in the housing 31 shield the portions of the first and second right-angled plug signal contacts 11-1, 11-2, which portions do -not extend out at the backside of the housing 31. Also, the horizontal shielding plate part 81*a* and the vertical shielding plate part 81*b* of the upper shielding member 80 shield the substantially right-angled first and second contact portions 11-1*a* and 11-2*a*. Therefore, it is possible to effectively reduce the possibility that the positive signals (+) and the negative signals (−) transmitted through the first and second right-angled plug signal contacts 11-1, 11-2 in a balanced manner are affected by external electromagnetic waves.

Also, the body 30, the upper bracket 40 and the lower bracket 50 need not be made of resin, and may be made of other electrically insulating materials. The epoxy resin 100 may also be made of other electrically insulating materials.

Further, the present invention is not limited to these embodiments, but variations and modifications may be made without departing from the scope of the present invention.

The present application is based on Japanese priority application No.10-234707 filed on Aug. 20, 1998, the entire contents of which are hereby incorporated by reference.

What is claimed is:

1. A connector for balanced transmission comprising:

an electrically insulating body;

a plurality of pairs of pin-shaped angled-signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, each pair of angled-signal contact elements including a first angled-signal contact element transmitting positive signals and a second angled-signal contact element transmitting negative signals; and a plurality of angled-ground contact elements supported by said electrically insulating body and disposed alternately with said plurality of pairs of angled-signal contact elements, said angled-ground contact elements having a planar part which is uniform with respect to said pairs of angled-signal contact elements.

2. The plug connector of claim 1, wherein said first and second angled-signal contact elements are supported by a protruded insulating part provided in said substantially equal separation.

3. A connector for balanced transmission comprising:

an electrically insulating body;

a plurality of pairs of pin-shaped signal contact elements supported by said electrically insulating body such that the signal contact elements are placed within the electrically insulating body except at end portions thereof such that there is a substantially equal separation between said first angle-signal contact element and said second angle-signal contact element over a major portion of a length of said first and second angled-signal contact elements, each pair of signal contact elements including a first signal contact element transmitting positive signals and a second signal contact element transmitting negative signals; and a plurality of ground contact elements supported by said electrically insulating body and disposed alternately with said plurality of pairs of signal contact elements, said ground contact elements having a planar part which is uniform with respect to said pairs of signal contact elements, wherein each of said signal contact elements and ground contact elements has a first portion and a second portion, said second portion extending perpendicularly to a longitudinal direction of said first portion.

4. A connector for balanced transmission comprising:

an electrically insulating body;

a plurality of pairs of pin-shaped first and second angled-signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, with the first angled-signal contact element transmitting positive signals and the second angled-signal contact element transmitting negative signals; and a plurality of angled-ground contact elements supported by said electrically insulating body and disposed alternately with said plurality of pairs of first and second signal contact elements, said angled-ground contact elements having a planar part which is uniform with respect to said pairs of the first and second angled-signal contact elements, wherein said first and second angled-signal contact elements are impedance matched.

5. A connector for balanced transmission comprising:

an electrically insulating body;

a plurality of pairs of pin-shaped signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, each pair of signal contact elements including a first signal contact element transmitting positive signals and a second signal contact element transmitting negative signals; and a plurality of ground contact elements supported by said electrically insulating body and disposed alternately with said plurality of pairs of signal contact elements, said ground contact elements having a planar part which is uniform with respect to said pairs of signal contact elements, wherein each of said signal contact elements and ground contact elements has a first portion and a second portion to be connected to a printed circuit board, said second portion forming an angle with said first portion.

6. A connector for balanced transmission comprising:

an electrically insulating body;

a plurality of pairs of pin-shaped first and second angled-signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, with the first angled-signal contact element transmitting positive signals and the second angled-signal contact element transmitting negative signals; and a plurality of angled-ground contact elements supported by said electrically insulating body and disposed alternately with said plurality of pairs of first and second angled-signal contact elements, said angled-ground contact elements having a planar part which is uniform with respect to said pairs of first and second angled-signal contact elements, wherein one of said first and second angled-signal contact elements is provided with a length adjusting part.

7. A connector for balanced transmission comprising:

an electrically insulating body;

a plurality of pairs of pin-shaped first and second angled-signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, with the first angled-signal contact element transmitting positive signals and the second angled-signal contact element transmitting negative signals; and a plurality of angled-ground contact elements supported by said electrically insulating body and disposed alternately with said plurality of pairs of first and second angled-signal contact elements, said angled-ground contact elements having a planar part which is uniform with respect to said pairs of first and second angled-signal contact elements, wherein said second angled-signal contact elements is provided with a length adjusting part.

8. A connector for balanced transmission comprising:

an electrically insulating body;

a plurality of pairs of pin-shaped first and second angled-signal contact elements supported by said electrically insulating body such that the angled-signal contact elements are placed within the electrically insulating body except at end portions thereof such that there is a substantially equal separation between said first angle-signal contact element and said second angle-signal contact element over a major portion of a length of said first and second angled-signal contact elements, with the first angled-signal contact element transmitting positive signals and the second angled-signal contact element transmitting negative signals; and a plurality of angled-ground contact elements supported by said electrically insulating body and disposed alternately with said plurality of pairs of first and second angled-signal contact elements, said angled-ground contact elements having a planar part which is uniform with respect to said pairs of first and second angled-signal contact elements, wherein said second angled-signal contact elements is provided with a length adjusting part having a cranked shape.

* * * * *